United States Patent [19]

Castonguay

[11] Patent Number: 5,060,107

[45] Date of Patent: Oct. 22, 1991

[54] MOLDED CASE CIRCUIT BREAKER OPERATING HANDLE GUARD

[75] Inventor: Roger N. Castonguay, Terryville, Conn.

[73] Assignee: General Electric Company, New York, N.Y.

[21] Appl. No.: 608,789

[22] Filed: Nov. 5, 1990

[51] Int. Cl.[5] ..... H01H 9/28

[52] U.S. Cl. ..... 361/115; 200/43.19; 200/321; 335/6; 361/357; 361/376

[58] Field of Search ..... 361/18, 114, 115, 353, 361/363, 357, 376; 335/6, 13, 14, 20, 18; 337/79; 200/43.01, 43.16, 43.19, 43.22, 308, 309, 321, 322, 329, 334, 83 C, 83 N, 83 P; 267/110, 158, 159, 164

[56] References Cited

U.S. PATENT DOCUMENTS

| | | | |
|---|---|---|---|
| 4,300,030 | 11/1981 | Dimarco et al. | 200/42 |
| 4,589,052 | 5/1986 | Dougherty | 361/94 |
| 4,728,914 | 3/1988 | Morris et al. | 335/6 |
| 4,736,174 | 4/1988 | Castonguay et al. | 335/167 |
| 4,794,356 | 12/1988 | Yu et al. | 335/13 |
| 4,796,154 | 1/1989 | Morris et al. | 361/353 |
| 4,806,893 | 2/1989 | Castonguay et al. | 335/20 |

*Primary Examiner*—Gerald P. Tolin

*Attorney, Agent, or Firm*—Richard A. Menelly; Walter C. Bernkopf; Fred Jacob

[57] ABSTRACT

A molded case circuit breaker with a visual access slot next to the circuit breaker operating handle allows the conditions of the circuit breaker contacts to be visually ascertained. To prevent inadvertent displacement of the circuit breaker operating handle when the circuit breaker is connected within an electrical distribution circuit, a handle guard is positioned over the circuit breaker operating handle. The handle guard is arranged such that the circuit breaker operating handle is free to reciprocate between the ON, OFF and TRIPPED positions while the operating handle guard is in position.

6 Claims, 5 Drawing Sheets

MOLDED CASE CIRCUIT BREAKER OPERATING HANDLE GUARD

BACKGROUND OF THE INVENTION

The use of industrial-rated circuit breakers within lighting panelboard and switchboard enclosures connected with industrial equipment sometimes requires that the circuit breaker handles be locked in an ON or OFF position to prevent inadvertent opening or closing of the circuit breaker contacts. This is especially important when electrical equipment is turned OFF for maintenance and repair purposes and the electrical equipment is visually remote from the panelboard or switchboard enclosure. When such a circuit breaker is locked in an ON position, it is important that the circuit breaker be allowed to trip to interrupt the circuit through the protected equipment upon the occurrence of an overcurrent condition. U.S. Pat. No. 4,300,030 describes a circuit breaker handle blocking attachment that allows the circuit breaker to move to a TRIPPED position. A tool such as a screwdriver is required for mounting and dismounting the handle blocking attachment from the circuit breaker handle.

To ensure that the circuit breaker handle remains in the ON or OFF position, a circuit breaker handle interlock such as described in U.S. patent application Ser. No. 481,012 filed Feb. 16, 1990 entitled "Circuit Breaker Handle Interlock Arrangement" is employed. In order to change the position of the circuit breaker operating handle, the padlock must be unlocked and removed from the handle interlock.

With most state-of-the-art circuit breaker operating handle interlock and blocking arrangements, it is difficult to ascertain the position of the underlying circuit breaker operating handle to determine whether the circuit breaker contacts are in their "OPEN", "CLOSED" or "TRIPPED" positions. U.S. Pat. No. 4,796,154 describes a circuit breaker contact status indicating handle wherein a visual access slot next to the circuit breaker operating handle indicates immediately to an observer the condition of the circuit breaker contacts by the use of appropriately colored indicia. This patent is incorporated herein for purposes of reference.

One purpose of the invention accordingly, is to provide a simple and economical means for preventing either inadvertent or intentional operation of the access to the position of the operating handle. A further purpose of the invention is to provide a circuit breaker operating handle blocking means which allows the circuit breaker operating handle to be set at its ON or OFF position without interfering with the travel of the operating handle to its TRIPPED position.

SUMMARY OF THE INVENTION

The invention comprises a C-shaped circuit breaker operating handle guard that is inserted within the circuit breaker operating handle slot in the circuit breaker cover. The handle guard is initially compressed to allow the opposite ends thereof to engage the opposite edges of the circuit breaker operating handle slot before releasing the handle guard to bias the ends of the handle guard between the slot edges. An arcuate opening defined beneath the bottom of the handle guard allows the operating handle to transfer in either direction within the handle slot.

DESCRIPTION OF THE PREFERRED EMBODIMENT

Figure 1:
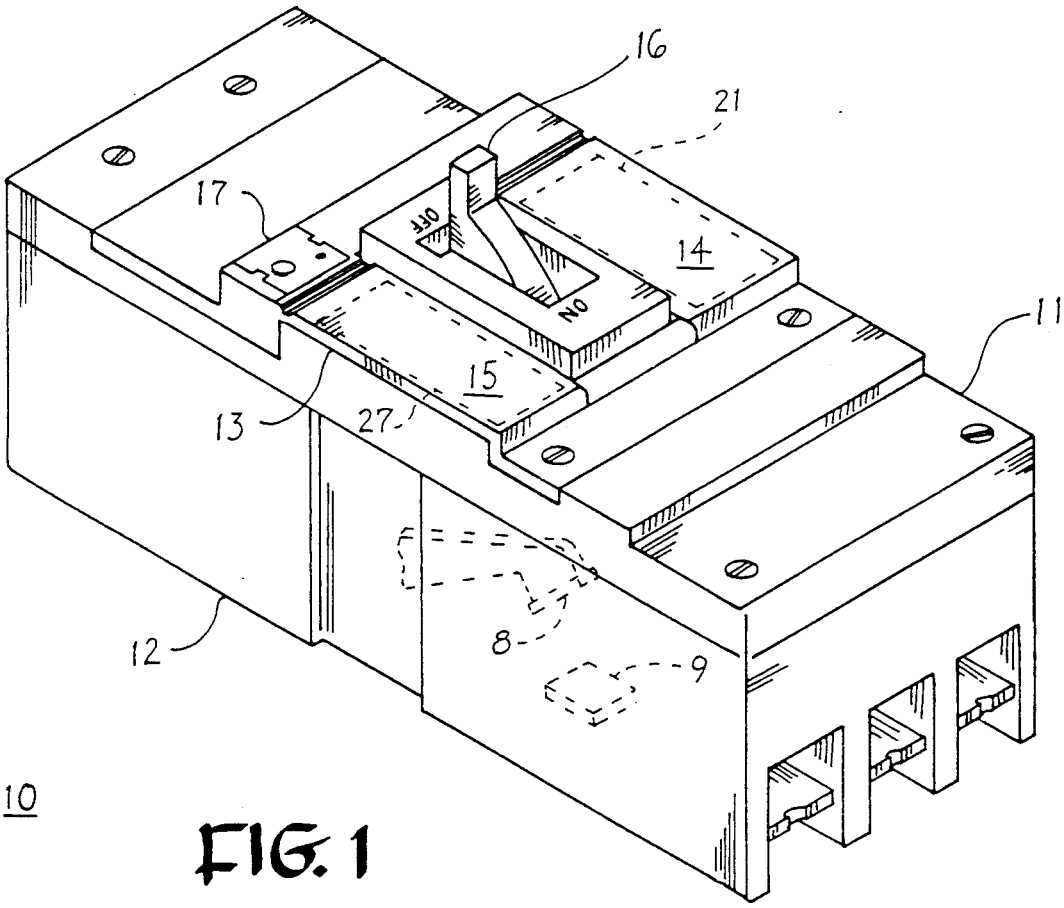
FIG. 1 (PRIOR ART)
FIG. 1 is a top prospective view of a molded case circuit breaker in accordance with the prior art.

A circuit breaker 10 having an electronic trip unit is depicted in FIG. 1 and consists of a case 12 to which a cover 11 is fixedly secured. An accessory cover 13 which includes a pair of accessory doors 14, 15 is attached to the circuit breaker cover and provides access to the actuator-accessory unit 21 and the auxiliary switch accessory 27 contained therein. An operating handle 16 extends through the circuit breaker cover and allows for manual intervention to turn the circuit breaker contacts 8, 9 between their closed and open positions. A rating plug 17 allows a single circuit breaker design to be used over a wide range of circuit interruption ratings. The rating plug is described within U.S. Pat. No. 4,728,914 entitled "Rating Plug Enclosure for Molded Case Circuit Breakers". One example of an auxiliary switch accessory is found within U.S. Pat. No. 4,794,356 entitled "Molded Case Circuit Breaker Auxiliary Switch Unit".

Figure 2:
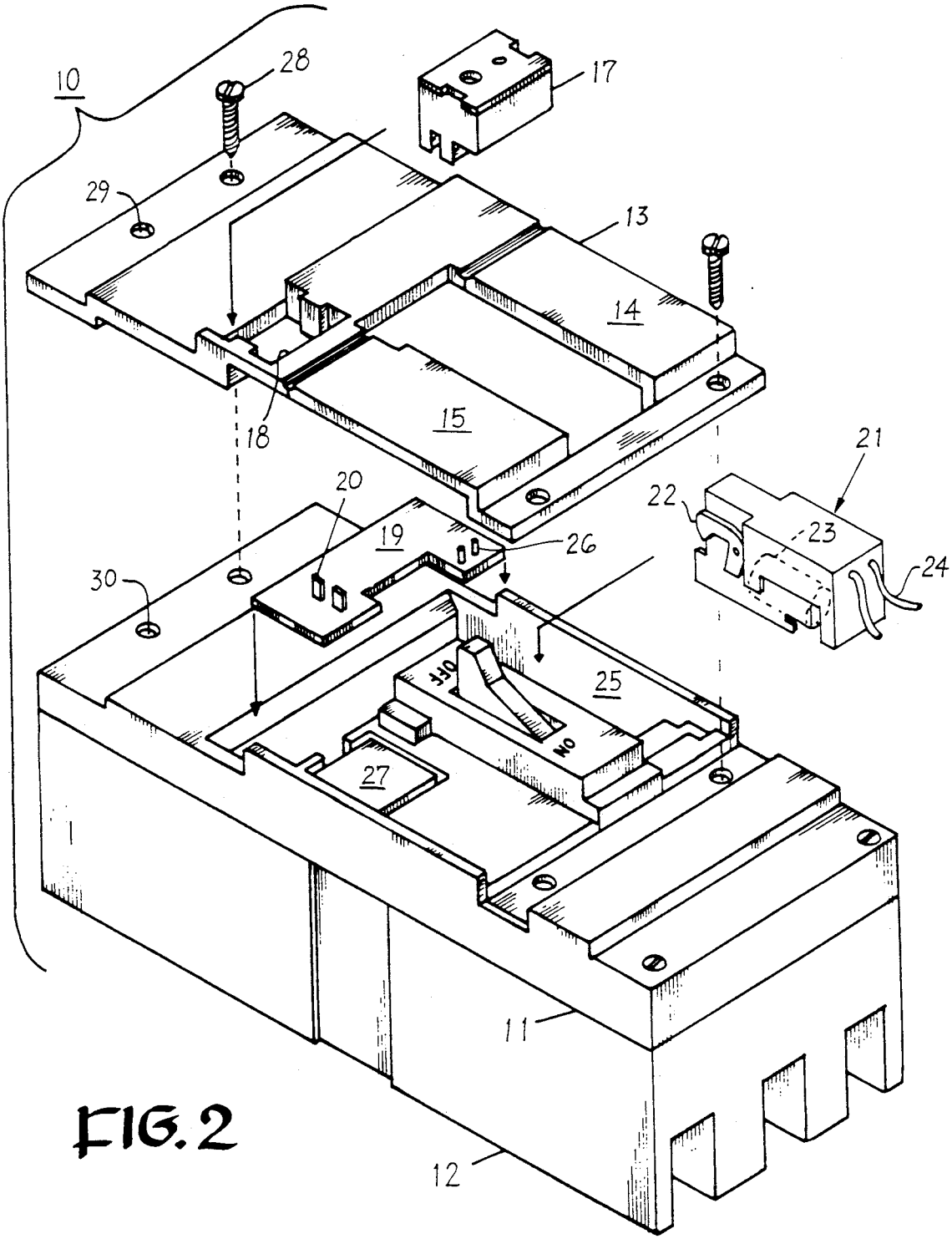
FIG. 2 is a top perspective view of the circuit breaker of FIG. 1 prior to inserting the circuit breaker electrical components within the circuit breaker cover.

The circuit breaker 10 is depicted in FIG. 2 with the circuit breaker cover 11 attached to the case 12 but prior to connecting the accessory cover 13 to the circuit breaker cover 11 by means of screws 28, thru-holes 29 and threaded openings 30. The rating plug 17 is first positioned within the rating plug recess 18 such that when the trip unit 19 is positioned within the circuit breaker cover, the upstanding pin connectors 20 electrically connect the rating plug with the trip unit circuit when the accessory cover 13 is later attached to the circuit breaker cover. Electrical connection with the actuator-accessory unit 21 is made by means of the pin connectors 26 upstanding at the opposite end of the trip unit. Although not shown, the circuit breaker includes an operating mechanism within the case 12 such as described within U.S. Pat. No. 4,736,174 entitled "Molded Case Circuit Breaker Operating Mechanism". The actuator-accessory unit 21 interacts with the operating mechanism by means of the trip latch 22 which is controlled by means of the trip coil 23. Remote electrical connection is made with the actuator-accessory unit 21 by means of the conductors 24. The actuator-accessory 21 is positioned within the actuator-accessory recess 25 formed in the circuit breaker cover beneath the accessory door 14 whereas the auxiliary switch accessory 27 is positioned under the other accessory door 15. A good description of the actuator-accessory unit is found within U.S. Pat. No. 4,806,893 entitled "Molded Case Circuit Breaker Actuator-Accessory Unit" and a good description of the trip circuit within the trip unit 19 is found within U.S. Pat. No. 4,589,052 entitled "Digital $I^2T$ Pickup, Time Bands and Timing Control Circuits for Static Trip Circuit Breakers". All of the aforementioned U.S. Patents are incorporated herein for purposes of reference.

Figure 3:
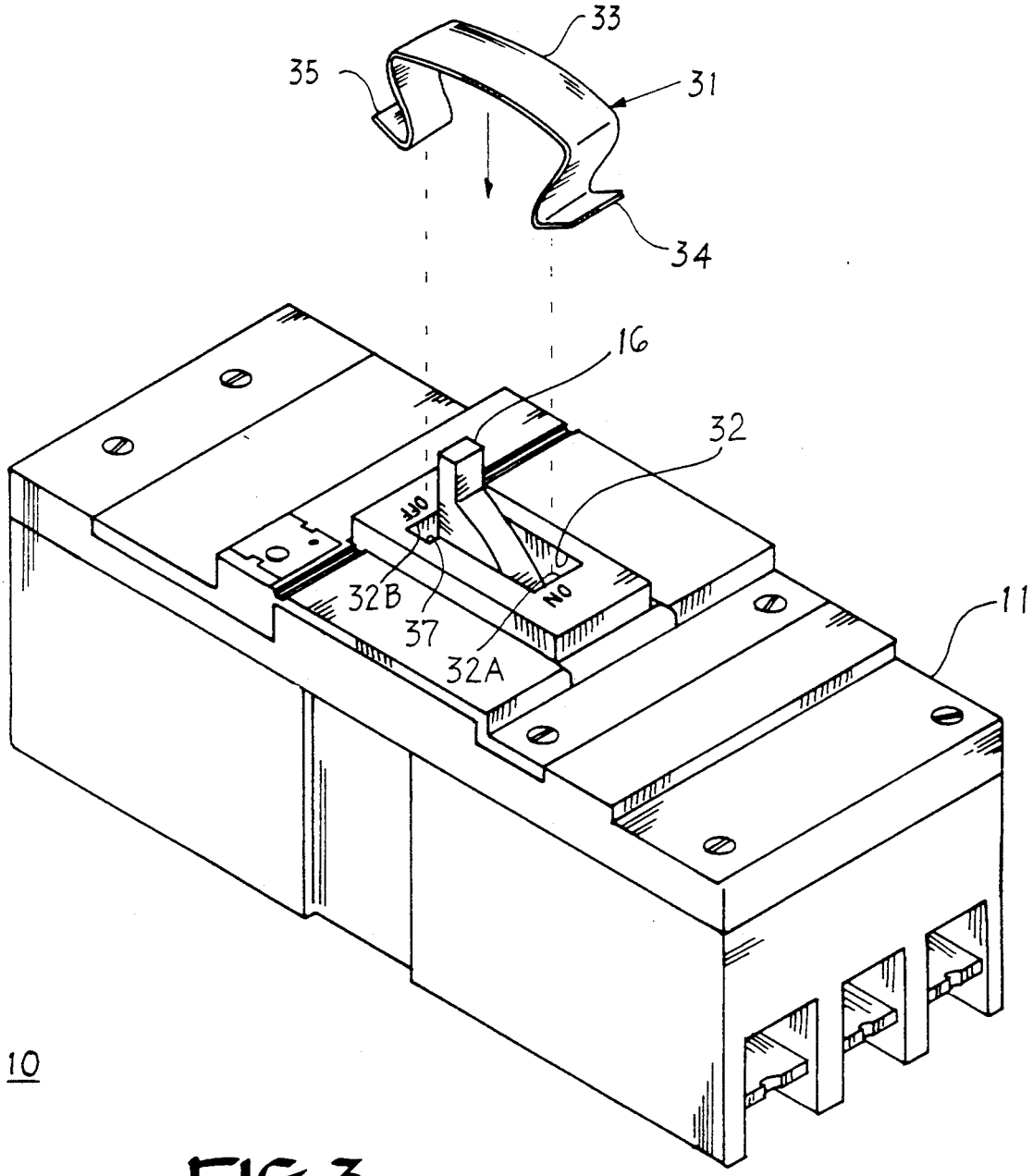
FIG. 3 is a top perspective view of the circuit breaker of FIG. 1 with the operating handle guard according to the invention depicted in isometric projection.

A handle guard 31, in the form of a C-shaped spring clip 33 having reverse S-shaped ends 34, 35 is shown in FIG. 3. The handle guard is made from a resilient metal such as steel, phosphor bronze, etc. or plastic such as Noryl which is a registered trademark of GE Company for phenylene-oxide and Valox which is a registered trademark of GE Company for polybutylene terepthalate. The handle guard is positioned within the handle slot 32 by compressing the center part of the spring clip and inserting the ends within the handle slot such that one end 34 engages one side 32A of the handle slot and the other end 35 engages the opposite side 32B of the handle slot. With the handle guard positioned over the operating handle 16, the operating handle can transfer unimpeded in both directions within the slot. The ability of the circuit breaker operating handle to transfer back and forth from the "ON"-to-"TRIPPED"-to-"OFF" positions within the handle slot is an important feature of the invention.

Figure 4:
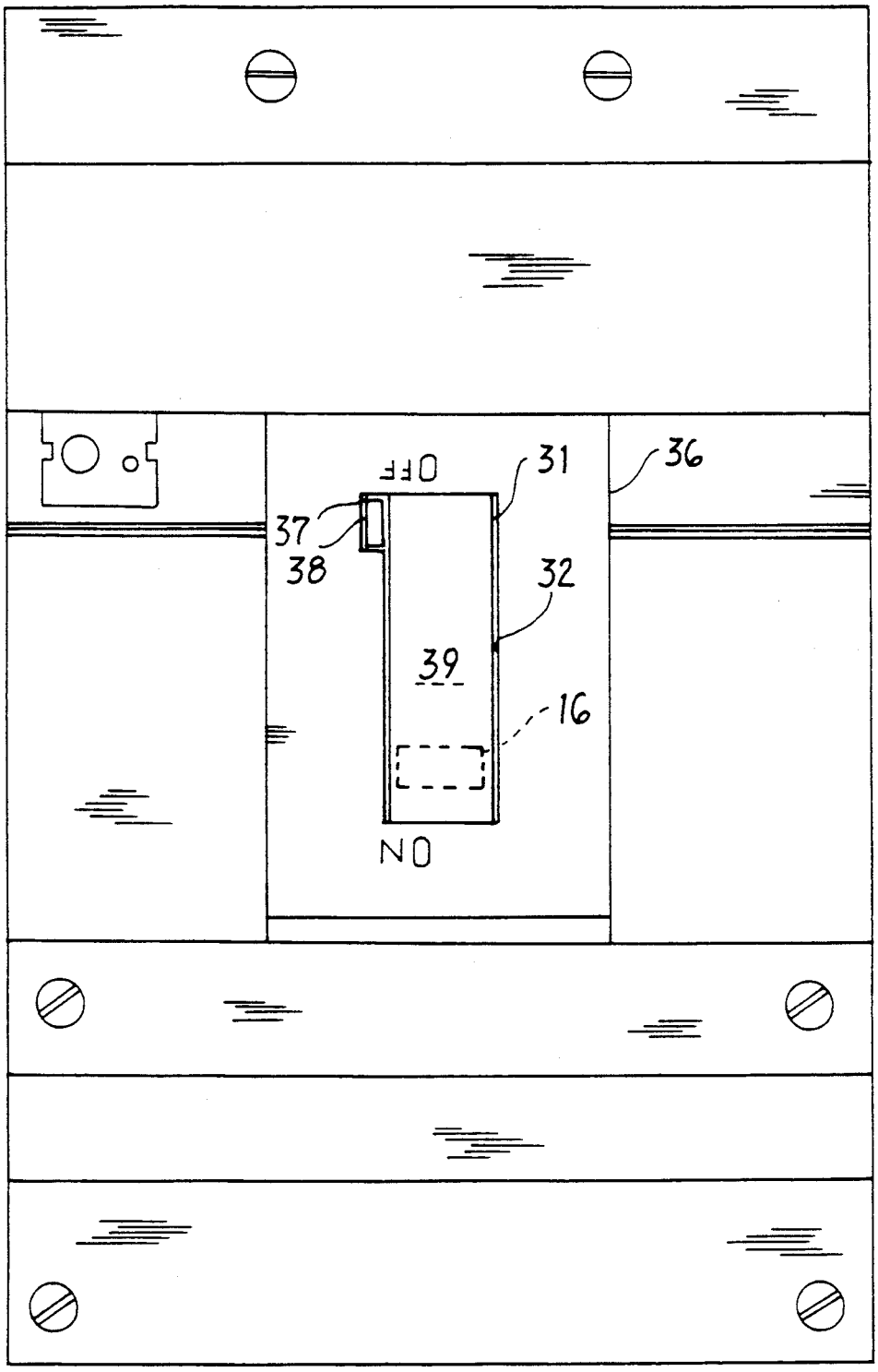
FIG. 4 is a top plan view of the circuit breaker of FIG. 3 with the handle guard positioned over the circuit breaker operating handle.
Figure 4A:
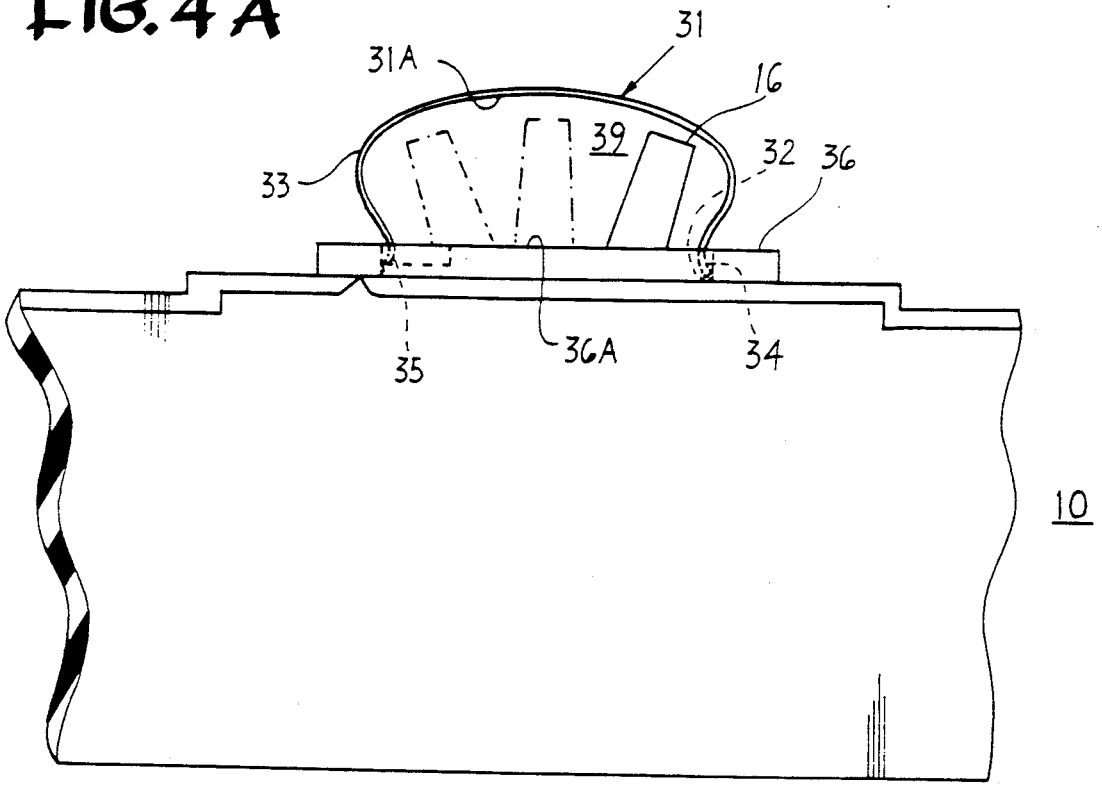
FIG. 4A is a partial side view of the circuit breaker of FIG. 4.

The location of the viewing slot 37 on the handle escutcheon 36 to allow the status of the circuit breaker contacts to be ascertained by means of colored indicia 38 is depicted in the circuit breaker 10 shown in FIG. 4. The unimpeded transfer of the operating handle 16 within the handle slot 32 with the handle guard 31 positioned within the handle slot is possible by the provision of a clearance space 39 defined beneath the handle guard as best seen in FIG. 4A.

The circuit breaker operating handle 16 is depicted in solid lines to the right of the handle slot which represents the closed conditions of the circuit breaker contacts. The operating handle is depicted in phantom toward the center of the slot which represents the "TRIPPED" conditions of the circuit breaker contacts and is indicated in phantom to the left of the handle slot which represents the "OPEN" conditions of the circuit breaker contacts. The handle guard, clearance space 39 defined between the bottom 31A of the handle guard and the top 36A of the operating handle escutcheon 36 allows the circuit breaker operating handle to freely transfer within the clearance space while still preventing manual access to the operating handle. To remove the handle guard from the handle slot 32, the C-shaped spring 33 is compressed to release the reverse S-shaped ends 34, 35 from the edges of the handle slot and is lifted out from the slot to thereby provide manual access to the circuit breaker operating handle.

Having thus described my invention, what I claim as new and desire to secure by Letters Patent is:

1. A molded case circuit breaker comprising:

a plastic case and cover;

a pair of contacts within said case arranged for interrupting current through a protected circuit;

an operating mechanism within said case connecting with said contacts and separating said contacts upon occurrence of an overcurrent condition within said protected circuit;

an operating handle extending through a handle slot in said cover and connecting with said operating mechanism for manual opening and closing said contacts in the absence of said overcurrent condition;

a visual access slot in said cover providing indication of TRIPPED, OPEN and CLOSED conditions of said contacts; and a handle guard having opposite ends positioned within said handle slot with a central part extending over said operating handle, said operating handle being free to move traversely within said handle slot when said contacts are in said TRIPPED, OPEN and CLOSED conditions under said handle guard.

2. The circuit breaker of claim 1 wherein said central part comprises a C-shaped spring and opposite ends comprise a reverse S-shaped configuration.

3. The circuit breaker of claim 1 wherein said handle guard comprises a metal or plastic composition.

4. The circuit breaker of claim 1 wherein said handle guard defines an arcuate clearance slot between a bottom of said handle guard and a top of circuit breaker cover to allow said handle to traverse freely within said handle slot.

5. The circuit breaker of claim 3 wherein said metal comprises phosphor bronze.

6. The circuit breaker of claim 3 wherein said metal comprises steel.

* * * * *